United States Patent [19]

Moscrip

[11] 4,429,732

[45] Feb. 7, 1984

[54] REGENERATOR STRUCTURE FOR STIRLING-CYCLE, RECIPROCATING THERMAL MACHINES

[76] Inventor: William M. Moscrip, Rte. 2, Box 474, Fredericksburg, Va. 22405

[21] Appl. No.: 403,772

[22] PCT Filed: May 14, 1982

[86] PCT No.: PCT/US82/00650

§ 371 Date: Jul. 28, 1982

§ 102(e) Date: Jul. 28, 1982

[87] PCT Pub. No.: WO82/04100

PCT Pub. Date: Nov. 25, 1982

[51] Int. Cl.[3] ..... F28D 17/00

[52] U.S. Cl. ..... 165/10; 60/526; 165/185

[58] Field of Search ..... 165/10, 185; 60/526

[56] References Cited

U.S. PATENT DOCUMENTS 3,445,910 5/1969 Duryee et al. ..... 165/10 X
3,913,666 10/1975 Bayliss .

*Primary Examiner*—Albert W. Davis, Jr.
*Attorney, Agent, or Firm*—W. Brown Morton, Jr.

[57] ABSTRACT

A novel construction of the regenerator element of regenerative thermal machines, particularly Stirling-cycle engines, is disclosed. The new regenerator construction makes specific use of the physical anisotropy of certain materials such as pyrolytic graphite to improve regenerator heat transfer and storage performance characteristics.

4 Claims, 3 Drawing Figures

REGENERATOR STRUCTURE FOR STIRLING-CYCLE, RECIPROCATING THERMAL MACHINES

TECHNICAL FIELD

This invention relates to Stirling-cycle engines, to other regenerative thermal machines, and more particularly to a new method for the construction of the regenerator element common to all such machines. The new method involves the deliberate incorporation of certain anisotropic materials such as pyrolytic graphite to improve the heat transfer and storage performance characteristics of the regenerator. This will enhance the overall performance of regenerative thermal machines, especially those which embody a practical approximation to the well known Stirling thermodynamic cycle in the production of both mechanical power (i.e. prime movers, compressors, fluid pumps) and refrigeration (i.e. refrigerators, air conditioners, heat pumps, gas liquefiers).

A Stirling-cycle engine is a machine which operates on a closed regenerative thermodynamic cycle, with periodic compression and expansion of a gaseous working fluid at different temperature levels, and where the flow is controlled by volume changes in such a way as to produce a net conversion of heat to work, or vice versa. The regenerator is a device which in prior art takes the form of a porous mass of metal in an insulated duct. This mass takes up heat from the working fluid during one part of the cycle, temporarily stores it within the machine until a later part of the cycle, and subsequently returns it to the working fluid prior to the start of the next cycle. Thus the regenerator may be thought of as an oscillatory thermodynamic sponge, alternately absorbing and releasing heat with complete reversibility and no loss.

A reversible process for a thermodynamic system is an ideal process, which once having taken place, can be reversed without causing a change in either the system or its surroundings. Regenerative processes are reversible in that they involve reversible heat transfer and storage; their importance derives from the fact that idealized reversible heat transfer is closely approximated by the regenerators of actual machines. Thus the Stirling engine is the only practical example of a reversible heat engine which can be operated either as a prime mover or as a heat pump.

BACKGROUND

The Stirling-cycle engine was first conceived and reduced to practice in Scotland 164 years ago. A hot-air, closed-cycle prime mover based on the principle was patented by the Reverend Robert Stirling in 1817 as an alternative to the explosively dangerous steam engine. Incredibly, this event occurred early in the Age of Steam, long before the invention of the internal combustion engine and several years before the first formal exposition of the Laws of Thermodynamics.

Air was the first and only working fluid in early 19th century machines, whereas hydrogen and helium have been the preferred working fluids for modern machines. In Great Britain, Europe, and the United States thousands of regenerative hot air prime movers in a variety of shapes and sizes were widely used throughout the 19th century. The smaller engines were reliable, reasonably efficient for their time, and most important, safe compared with contemporary reciprocating steam engines. The larger engines were less reliable, however, because they tended to overheat and often succumbed unexpectedly to premature material failure.

Toward the end of the 19th century the electric motor and the internal combustion engine were developed and began to replace not only the Stirling-cycle engines, but also the reciprocating steam engines of that era. These new machines were preferred because they could produce greater power from more compact devices and because they were more economical to manufacture. The limitations of early, as well as those of current Stirling engines are in part directly attributable to the design and performance characteristics of the regenerator element. Both the specific power capacity and the overall thermal efficiency of regenerative thermal machines are direct consequences of the inherent performance characteristics and heat transfer properties of the regenerator.

Since World War II there have been unprecedented advances in the general technologies of machine design, heat transfer, materials science, system analysis and simulation, manufacturing methods, and Stirling engine development. Today, in comparison to their conventional internal combustion counterparts, all modern Stirling-cycle prime movers are external combustion engines which consistently demonstrate (in the laboratory) higher efficiency, multifuel capability, lower exhaust emissions, quieter operation, equivalent power density, and superior torque characteristics.

Nevertheless, none of these engines is mass produced for any commercial application anywhere in the modern world. The reason for this is that contemporary Stirling engines have been developed largely by adapting traditional methods and designs from the more familiar internal combustion engine technology base. Patchwork adaptation of the old as a shortcut to the new is a process which inexorably produces a hodgepodge arrangement of excessive mechanical complexity and which inevitably results in high production costs.

The modern regenerator construction, for example, is an awkward, although servicable, design compromise among conflicting requirements for efficient heat transfer, minimum flow losses, and maximum packing density. The use of traditional materials and methods offers no thoroughly satisfactory solutions to this dilemma. Despite clearly superior technical performance characteristics, therefore, contemporary Stirling engines are invariably not cost competitive from the standpoint of economical mass production.

DISCLOSURE

The invention comprises fundamental concepts and mechanical components which in combination enhance the operation yet lower the cost of Stirling-cycle machines, by means of the use of a regenerator which employs materials of construction which have anisotropic symmetry to achieve anisotropic thermal conductivity and large specific heat capacity in a thermal mass having the highest practicable ratio of exposed surface area to cross-sectional flow area.

It is a primary object of the invention to provide a novel form of regenerator, designed to incorporate certain materials such as pyrolytic graphite, which possess anisotropic symmetry in addition to the desirable physical properties of low desnity and high heat capacity, thereby inherently exhibiting a high thermal conductivity in directions normal to the flow of working fluid and a low thermal conductivity in the direction of the flow within the same contiguous mass.

BRIEF DESCRIPTION OF DRAWINGS

Other objects, advantages, and novel features of the invention will become readily apparent upon consideration of the following detailed description when read in conjunction with the accompanying drawings wherein:

FIG. 2(*c*) is a pressure-volume diagram which depicts the working of an actual machine;

and

Figure 3:
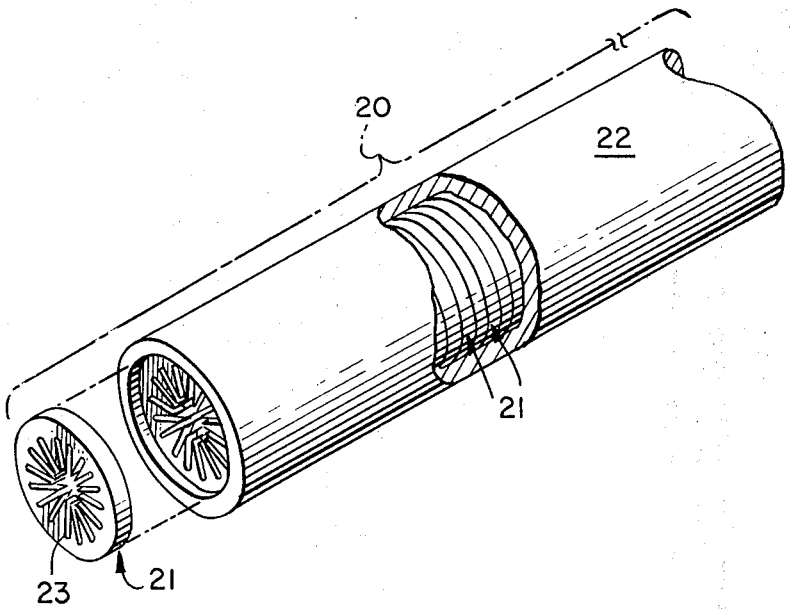

FIG. 3 is an illustration of the construction of a regenerator element using anisotropic perforated disks.

Best Mode For Carrying Out Invention

Figure 1:
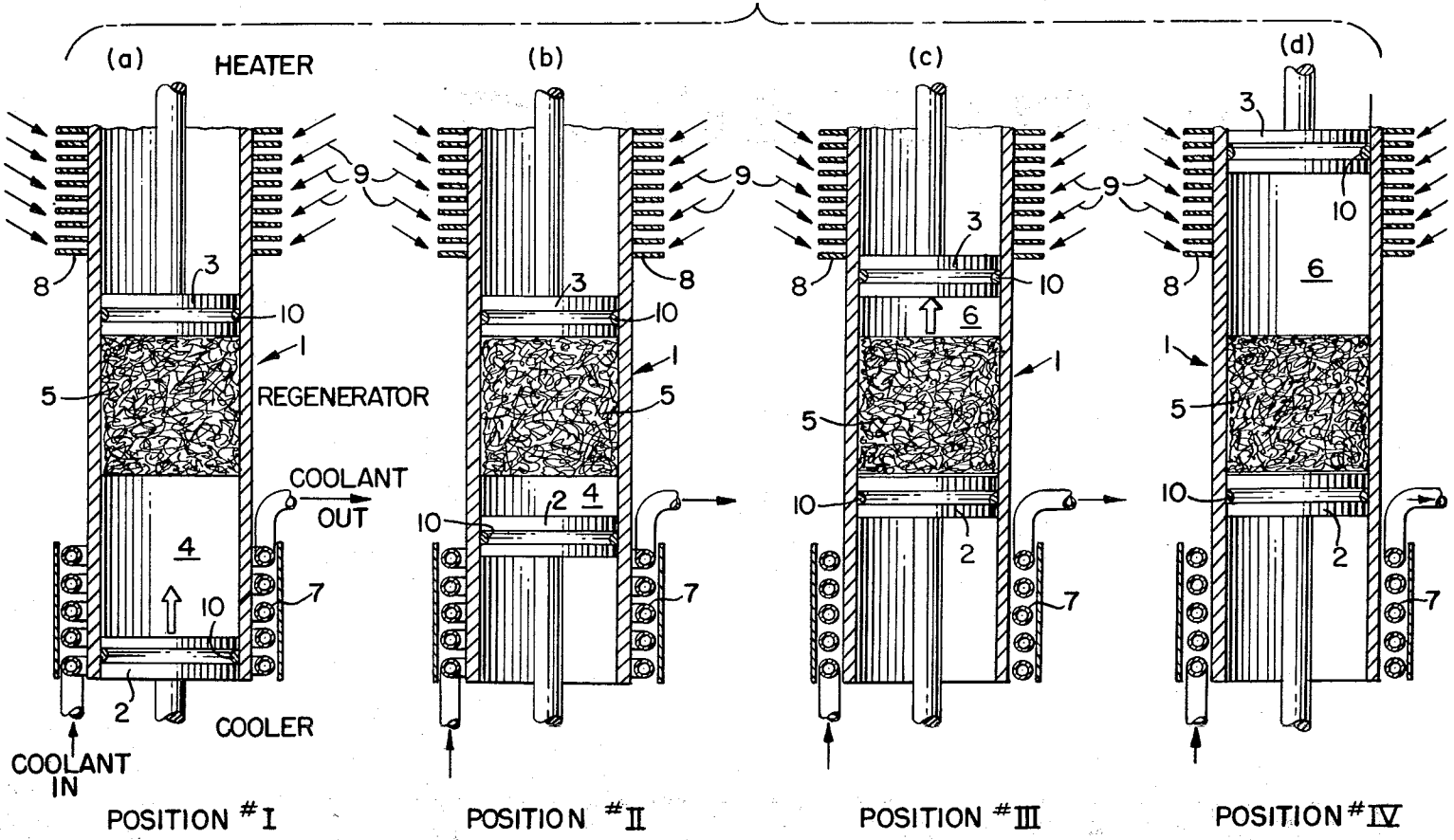
FIG. 1 is an illustration of the operational sequence of events during one complete cycle of an idealized single-acting two-piston Stirling engine used in the prime mover mode.

Attention is directed to FIG. 1 wherein numeral 1 designates an idealized version of a two-piston Stirling-cycle prime mover. A conceptually constant mass of pressurized gaseous working fluid occupies the working volume between the compression piston 2 and the expansion piston 3. The total working volume is comprised by compression space 4, regenerator 5, and expansion space 6. A portion of compression space 4 is continually cooled by cooler 7, while a portion of expansion space 6 is continually heated by heater 8. Arrows 9 are intended to represent the input of heat by conduction, convection, or radiation. Escape of fluid from the working volume is prevented by the piston seals 10.

During the compression stroke (between positions I and II) the working fluid is compressed isothermally by piston 2 at the minimum temperature level of the cycle. Heat is continually rejected at this temperature through cooler 7; the pressure rises slightly and the total working volume decreases to a minimum. During the forward displacement (cold-side to hot-side transfer) stroke (between positions II and III) regenerator 5 yields stored heat to the working fluid as it is transferred to expansion space 6 with the volume remaining constant. The temperature and pressure rise to their maximum levels.

During the expansion stroke (between positions III and IV) the working fluid expands isothermally at the maximum temperature level of the cycle, doing work on piston 3. The temperature level is maintained by the input of heater 8; the pressure drops and the total working volume increases to a maximum. During the reverse displacement (hot-side to cold-side transfer) stroke (between positions IV and I) regenerator 5 recovers heat from the working fluid as it is transferred to compression space 4 with the volume remaining constant. The temperature and pressure return to the starting levels of the cycle.

Figure 2:
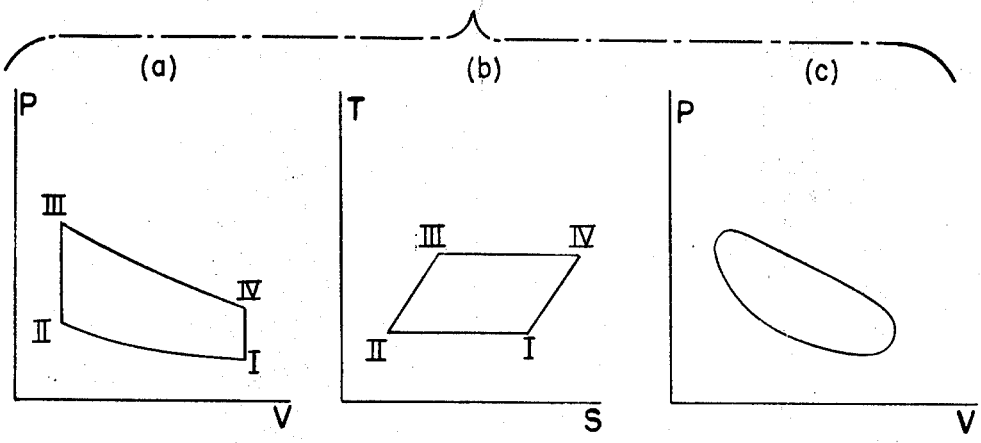
FIG. 2(*a*) and FIG. 2(*b*) are schematics which illustrate the idealized pressure-volume and temperature-entropy diagrams of the thermodynamic cycle of the working fluid in the same machine depicted by FIG. 1.

A clearly understanding of the foregoing may be obtained by referring to the diagrams of FIG. 2(*a*) and FIG. 2(*b*) wherein the same complete cycle is presented in terms of the pressure-volume diagram and the temperature-entropy diagram for the working fluid. For each process as depicted by the curves between the indicated position numbers I-II, II-III, III-IV, and IV-I, the area under a curve on the P-V diagram is a representative measure of the mechanical work added to or removed from the system during the process. Similarly, the area under a curve on a T-S diagram is a measure of the heat transferred to or rejected from the working fluid during the process.

Actual machines differ fundamentally from the idealized versions in that the motion of each piston is continuous and smooth, rather than discontinuous and abrupt. This causes the indicated processes of FIG. 2(*a*) and FIG. 2(*b*) to overlap one another, and results in P-V diagrams which are smooth continuous curves devoid of sharp corners as shown by FIG. 2(*c*). Thus the piston motion of actual machines is smoothly periodic to the point of being sinusoidal, and the working fluid is likewise distributed in a periodically time-variant manner throughout the total working volume.

As previously noted, the regenerator is a device comprised by a thermal mass so arranged and deployed within a thermal machine that it takes up heat from the working fluid during one part of the cycle, temporarily stores it within the machine until a later part of the cycle, and subsequently returns it to the working fluid prior to the start of the next cycle. As explained in prior art U.S. Pat. No. 3,960,204, it is important to minimize longitudinal thermal conductivity of all regenerators. My concept proposes the utilization of the unique physical property known as bulk anisotropy, which is displayed by certain well-known materials such as pyrolytic graphite and pyrolytic boron nitride, for the construction of an advanced regenerator in the manner illustrated by FIG. 3.

It may be seen that regenerator 20 is nothing more than an ordered or stacked assemblage of perforated disk elements 21 contained within a tubular duct 22 which possesses a comparatively low thermal conductivity. The perforations 23, which may take many different forms, are designed so as to maximize the ratio of the perimeter of the perforation to the cross sectional area of the perforation. The basic purpose of this approach is to maximize both the capacity and the rate of heat transfer with respect to the material of the regenerator, while at the same time to minimize working fluid flow losses and longitudinal thermal conductivity losses within the regenerator.

Pyrolytic graphite is a polycrystalline form of carbon having a high degree of molecular orientation. It possesses no binder, has a very high purity, and may exceed 98.5o/o of the theoretical density for carbon. The material is usually produced by chemical vapor deposition onto a substrate which is maintained at an elevated temperature. Such deposits possess great high temperature strength, exceptional thermophysical properties, and phenomenal anisotropic symmetry. That is, they naturally and consistently exhibit one value for physical constants as measured in the plane of the deposit and compared to the value for the same constant as measured across the plane of the deposit.

It is a most remarkable, but nevertheless well-known fact that the thermal conductivity of pyrolytic graphite in the plane of the deposit is about equal to that of copper at room temperature (4.2 watts/cm$^2$/°C/cm); but the conductivity across the plane of the deposit is reduced by almost 200 to 1 (0.025 watts/cm$^2$/°C/cm). The corresponding values at 1000° C. are known to be similarly anomalous (1.25 watts/cm$^2$/°C/cm and 0.012 watts/cm$^2$/°C/cm) and the value of the specific heat at 750° C. (1182° F.) is known to be approximately 0.42 cal/g/°C., which is among the highest values for all structural engineering materials.

It is therefore an important specific teaching of this invention that a number of perforated disks 21 may be made of this or a similar material to have a comparatively large transaxial thermal conductivity (i.e., in the plane of the disk), yet to have a comparatively small axial thermal conductivity (i.e., across the thickness of the disk). The indicated assemblage of said perforated disks 21 would therefore comprise, when placed within the insulative cylindrical container 22, a remarkably efficient regenerator. It should be apparent that such a device would quickly and effectively transfer and store large amounts of heat to and from a fluid flowing within the internal duct formed by the superimposed perforations 23 due to the favorable thermal properties in the transaxial (or radial) direction, but would maintain a high temperature gradient in the direction of flow because of the low value of thermal conductivity in that direction.

Pyrolytic graphite also has a great difference in linear thermal expansion coefficients between the directions within the plane of the deposit and the direction perpendicular to the plane of the deposit. The average coefficient of linear thermal expansion from room temperature to 1000° C. is known to be $1.3\times10^{6}$ cm/cm/°C. in the plane of deposit and $22.0\times10^{-6}$cm/cm/°C. across the plane of deposit. The latter value should be matched by the wall of the containing vessel, in order to preclude or minimize thermal stresses; fortunately, it is reasonably close to that of many structural alloys of interest, including certain alloys of aluminum, manganese, and copper.

Since the closed cycle Stirling prime mover operates solely on the basis of the difference in temperature in the working fluid between the hot expansion space and the cold compression space, the development of useful power output is not specific to the source of heat available for use. Therefore, the design of the heat source can be any one of a large variety of possible types. A rather simple combustion system can be produced, for example, which will cleanly and efficiently burn various kinds of both liquid fuels and gaseous fuels without any modification whatsoever. Thus it will be appreciated by those familiar with the art that a single prime mover may be made to operate on regular or premium gasoline, diesel oil, alcohol, crude oil, lubricating oil, olive oil, vegetable oil, propane, butane, natural gas, and synthetic coal gas.

It is important at this point to re-emphasize the fact that each small segment of a well-designed regenerator transfers heat to and from the working fluid with minimal temperature differences. Thus all stages in the regenerator are reversible in an actual thermodynamic sense. Therefore, the entire machine cycle is reversible in function; that is, the direction of flow of heat and work can be reversed. The Stirling engine is truly unique in that it is the only practical example of a thermodynamically reversible machine.

It should be thoroughly understood, therefore, that many of the design concepts disclosed herein for Stirling prime movers are also applicable to the design and development of Stirling refrigerators, heat pumps, air conditioners, and the like. It is another important specific teaching of this invention that machines of this kind would be appreciably more efficient than conventional vapor cycle reciprocating refrigerators or thermally-activated absorption refrigerators, with a substantial savings in size and weight. In addition, a hybrid device obtained from the combination of a Stirling prime mover mechanically coupled to a Stirling heat pump will permit both multifuel and non-fuel powered refrigeration units to be developed and applied to specialized applications.

In view of the foregoing it should be readily apparent to those skilled in the art that the operation of the present invention may be accomplished by means of and in the context of an enormous variety of diverse applications. In fact, virtually every market in the world which is currently occupied by the application of a reciprocating internal combustion prime mover, or by the application of a conventional vapor cycle, absorption, or other type of refrigeration device, is subject to improvement by virtue of the diligent application of the teachings of this invention.

These include but are by no means limited to the following: automotive prime movers, marine prime movers, aeronautical prime movers, industrial prime movers, military prime movers, agricultural prime movers, multifuel prime movers, nonfuel prime movers, portable prime movers, biomedical prime movers, refrigerators, air conditioners, cryogenic cooling machines, residential heat pumps, industrial heat pumps, military heat pumps, water coolers, air compressors, other gas compressors, remote electric generators, portable electric generators, stationary electric generators, hydroelectric power converters, nuclear power converters, radioisotope power converters, solar power converters, geothermal power converters, ocean thermal power converters, biomass power converters, solid waste power converters, small cogeneration power plants, large cogeneration power plants, remote fluid pumps, portable fluid pumps, stationary fluid pumps, remote power tools, portable power tools, outdoor power tools, underwater power tools, toys and novelties.

Many modifications and variations of the present invention will occur to those skilled in the art in the light of the above teachings. Thus, every potential application of a Stirling-cycle engine accomplished by machines operating on the principles set forth herein will be, in and of itself, a special variation of this invention. It is therefore to be understood that, within the scope of the appended claims, my invention may be practiced otherwise than as specifically described.

I claim:

1. A regenerator structure for use in a Stirling-cycle, reciprocating, thermal machine comprising a gas-tight shell providing a conduit for machine working fluid, a thermal mass packing said shell comprised of wafers of solid material with tops and bottoms lying in parallel planes, stacked and perforated and having an outer periphery shaped to conform to the transverse sectional configuration of the interior of said shell, the perforations through said wafers being arranged to provide one or more passages through said packing, each having a high ratio of exposed surface area to cross-sectional flow area and said wafers being composed of material having anisotropic properties disposed to provide a high ratio of the thermal conductivity normal to the direction of the flow through said passage to the thermal conductivity in the direction of that flow.

2. A regenerator structure according to claim 3 in which the mass is composed of material selected from the group consisting of pyrolytic graphite and pyrolytic boron nitride.

3. A regenerator structure according to claim 1 in which the transverse sectional configuration of the shell is circular and the wafers are disks having a circular outer periphery.

4. A regenerator structure according to claim 1 in which the perforations through the wafers are normal to the planes of the wafers and are of the same shape, area, and disposition in each wafer and the wafers are so stacked that like perforations in each wafer are coaxial.

* * * * *